United States Patent [19]

Schmucker

[11] Patent Number: 4,566,262

[45] Date of Patent: Jan. 28, 1986

[54] METHOD AND APPARATUS FOR MONITORING THE OPERATION OF A FRICTION FALSE-TWISTING UNIT

[75] Inventor: Wolfgang Schmucker, Hammelburg, Fed. Rep. of Germany

[73] Assignee: FAG Kugelfischer Georg Schafer Kommanditgesellschaft auf Aktien, Fed. Rep. of Germany

[21] Appl. No.: 552,282

[22] Filed: Nov. 16, 1983

[30] Foreign Application Priority Data

Dec. 9, 1982 [DE] Fed. Rep. of Germany ..... 3245574

[51] Int. Cl.[4] ..... D02G 1/04; D01H 13/14

[52] U.S. Cl. ..... 57/264; 57/265; 57/338

[58] Field of Search ..... 57/264, 265, 332, 334, 57/337, 338, 339, 340, 92, 93, 94

[56] References Cited

U.S. PATENT DOCUMENTS

| | | | |
|---|---|---|---|
| 3,662,531 | 5/1972 | Carroll | 57/265 |
| 3,950,930 | 4/1976 | Shindo et al. | 57/264 |
| 3,994,123 | 11/1976 | Sholly | 57/264 |
| 4,015,414 | 4/1977 | Sholly | 57/338 X |
| 4,019,310 | 4/1977 | Seidl et al. | 57/265 |
| 4,068,460 | 1/1978 | Fischbach | 57/339 X |

FOREIGN PATENT DOCUMENTS

| | | |
|---|---|---|
| 1103066 | 8/1965 | United Kingdom . |
| 2015589 | 2/1979 | United Kingdom . |

*Primary Examiner*—Donald Watkins

*Attorney, Agent, or Firm*—Ostrolenk, Faber, Gerb & Soffen

[57] ABSTRACT

The production of defective yarn in a friction false-twisting unit is detected and prevented. Variations of speed of rotation caused by defects in drive elements, such as worn or jammed bearings or a damaged drive belt, are detected by comparing a signal indicating the speed of rotation of at least one shaft with a reference signal. If the signal differs from the reference signal, an electrical fault signal is generated. This fault signal may control a thread cutting device which cuts the thread coming from the unit; or the fault signal may go to a central thread monitoring station where an operator may observe that a fault has occurred.

23 Claims, 6 Drawing Figures

METHOD AND APPARATUS FOR MONITORING THE OPERATION OF A FRICTION FALSE-TWISTING UNIT

BACKGROUND OF THE INVENTION

1. Field of the Invention

The invention relates to a method of monitoring the operaton of a friction false-twisting unit for texturing thread.

2. Description of the Prior Art

Various thread monitoring and thread cutting devices are known which respond to irregularities in the thread, such as different stresses, broken thread, etc. One example is described in German Application DE-OS No. 30 05 746. These monitoring devices, however, are not capable of indicating irregularities such as variations in speed of rotation caused by defects in the drive elements, such as worn or jammed bearings or a damaged drive belt. The friction units continue to convey thread, which is found to be defective only during subsequent processing.

Friction false-twisting units typically include three driven shafts, each carrying friction disks, and the shafts are placed to that the disks are all interleaved. The shafts are driven by two toothed belts or by similar drive means and these present particular difficulties. The life of these drive belts, as is known, is not very long and differs greatly from one belt to the next. If only one belt tears in these units, the two other shafts are not affected and the thread continues to travel. Since the third shaft is not rotating, defective thread is produced. The defect itself is noted only by attentive personnel or during subsequent processing.

Similarly, a bearing may become worn or jammed. The two bearings which are still intact continue to travel with unreduced speed of rotation while the third shows irregularities. In this case also, defective thread may be detected only at a later time.

SUMMARY OF THE INVENTION

One object of the present invention is therefore to provide a method of monitoring the texturing process in a friction false-twisting unit to eliminate such defects.

This object is achieved by comparing the speed of rotation of at least one shaft with a reference value. If the speed differs from the reference value, a fault signal is generated. The invention assures that disturbances or variations in speed of rotation of the friction disks are recognized immediately and the possibly defective thread is identified. In one embodiment, a magnet or other pulse transmitter is mounted to the drive wheel or shaft and rotates with it, inducing a pulse each time the magnet passes a stationary pulse receiver. In another embodiment, the magnet is mounted on the drive belt connecting shafts. A comparison circuit receives the pulses from the pulse receiver and compares the pulses with a reference. All variations in speed of rotation are thus detected by the comparison circuit, which then emits a fault signal. The fault signal may cause a thread cutting device to cut the thread coming from that unit. The fault signals from all false-twisting points are received at a central monitoring station where an operator can see the location of the defective unit.

For the purpose of illustrating the invention, there are shown in the drawings several embodiments which are presently preferred, it being understood, however, that this invention is not limited to the precise arrangements and instrumentalities shown.

DETAILED DESCRIPTION OF THE PREFERRED EMBODIMENTS

Figure 1:
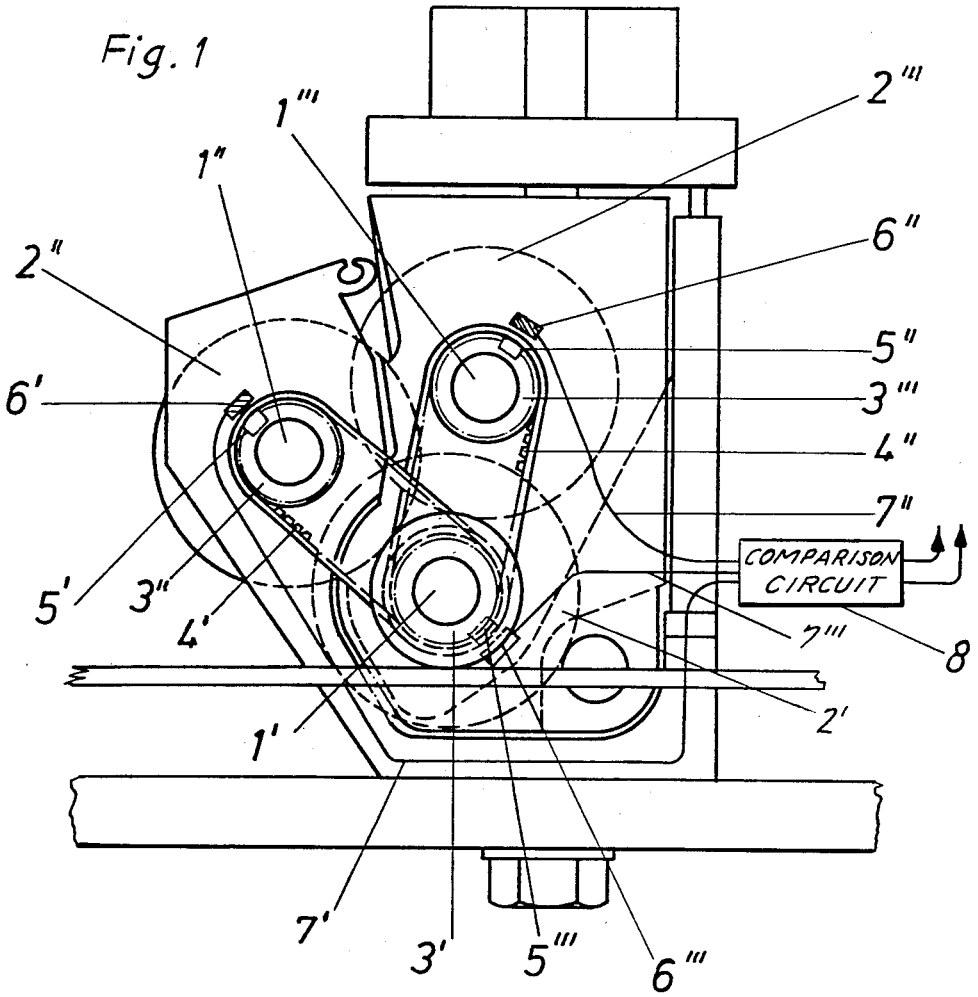
FIG. 1 shows a friction false-twisting unit in a view from the bottom, the magnets of the invention being anchored on the drive wheels.

FIG. 1 is a bottom view of a friction false-twisting unit showing one preferred embodiment of the invention. Shafts 1', 1'' and 1''' bear the friction disks 2', 2'' and 2''', respectively. In this embodiment, the shafts 1', 1'', 1''' form an equilateral triangle, and the shafts are so placed and the disks are so sized that the disks are interleaved. The thread passes through disks 2', 2'', 2''' in a zig-zag path. The drive wheels 3', 3'' and 3''' are also fastened on these shafts and are connected to each other via the drive belts 4' and 4''. Shaft 1' thus functions as a drive shaft, driving shafts 1'', 1'''. Pulse transmitters, which may be magnets 5', 5'' and 5''', are mounted in the drive wheels 3', 3'' and 3''' and rotate past pulse receivers 6', 6'', 6''', which may be Hall effect sensors or any other known pulse sensor circuits. The pulse receivers 6', 6'' and 6''', mounted in fixed positions, respond by transmitting signals via the lines 7', 7'' and 7''' to the comparison circuit 8 from which a fault signal is emitted to the central thread monitoring station if the comparison shows faulty operation.

In one alternative embodiment, the magnets are mounted on drive belts 4', 4''. More than one magnet may be mounted on each drive belt, provided they are suitably spaced to induce pulses in pulse receivers 6', 6'', 6''' which can be used for comparison.

Figure 2:
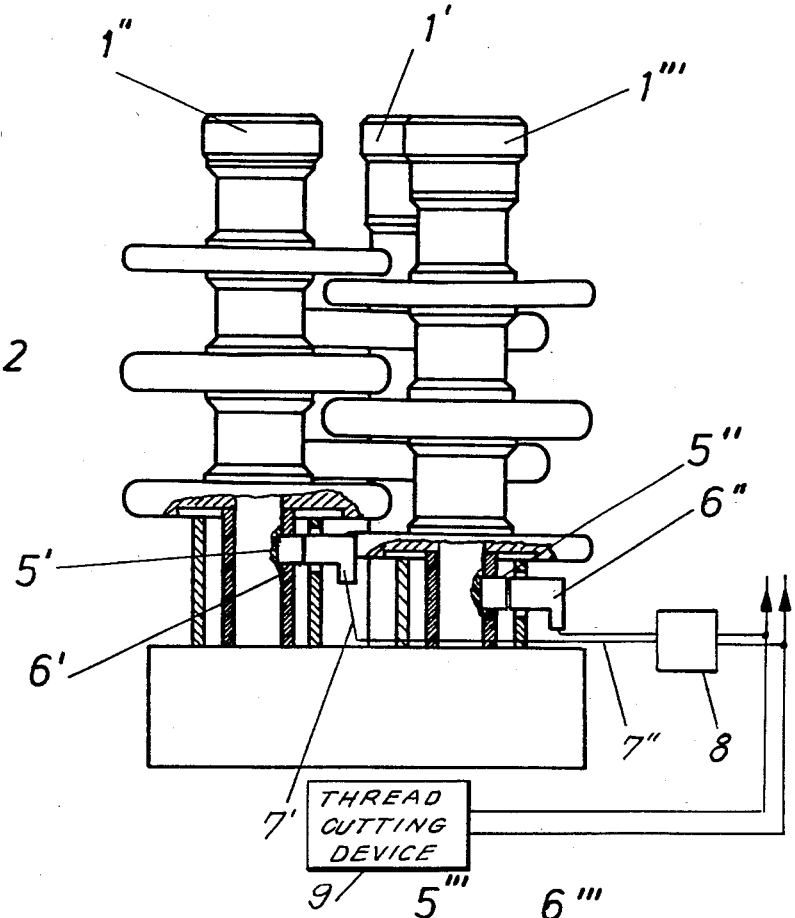
FIG. 2 shows a friction false-twisting unit in a view from the front, the magnets of the invention being arranged on the shaft.

FIG. 2 shows another preferred embodiment of the invention for monitoring speed of rotation directly from the shafts 1', 1'' and 1'''. The magnets 5', 5'' and 5''' are in this case directly mounted in the shafts 1', 1'' and 1'''. As in FIG. 1, pulse receivers 6', 6'' and 6''' transmit signals via lines 7', 7'', 7''' to comparison circuit 8, which signals any variation in speed of rotation to the central thread monitoring station. Also, as shown in FIG. 2, the signal may drive a thread cutting device 9, causing it to interrupt further movement of thread from the unit in case of faulty operation.

Figure 3:
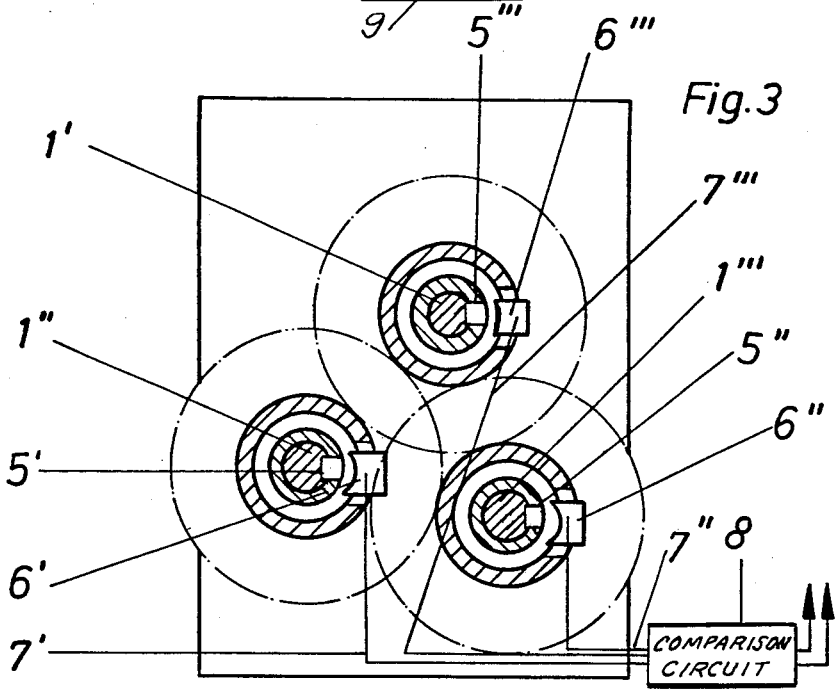
FIG. 3 shows a friction false-twisting unit in a view from the top, the shafts being cut away through the magnets of the invention.

FIG. 3 shows the friction false-twisting device of FIG. 2 in a cross-section seen from above. The shafts 1', 1'' and 1''' bear the magnets 5', 5'' and 5'''. The pulse receivers 6', 6'' and 6''' again transmit signals to comparison circuit 8 which, in turn, emits fault signals to the central thread monitoring station.

Figure 4:
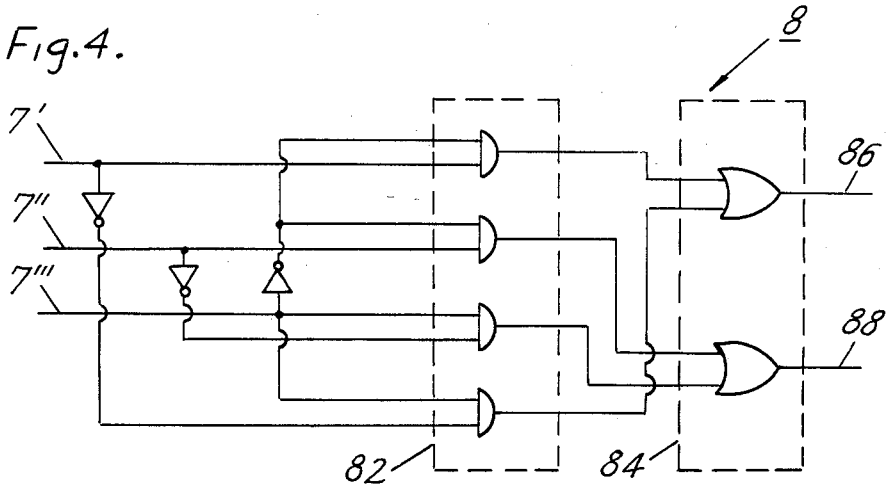
FIG. 4 is a schematic diagram of a simple comparison circuit for use in the invention.

FIG. 4 shows in detail an extremely simple comparison circuit 8 which may be used if, as shown in FIG. 3, the magnets 5', 5'', 5''' on all three shafts 1', 1'', 1''' ordinarily pass their respective pulse receivers 6', 6'', 6''' at the same time. In this embodiment, the speed of rotation of the main drive shaft 1' is used as a reference value, so that the signal from line 7''' is compared with the signals on each of the other lines 7', 7''. AND gates 82 take the logical product of the signal on line 7''' with the inverted signal from each of the other lines 7', 7'' and of the inverted signal on line 7''' with the signal from each of the other lines 7', 7''. OR gates 84 then combine these signals to provide a signal on line 86 if shaft 1'' is at a different speed and a signal on line 88 if shaft 1''' is at a different speed.

Figure 5:
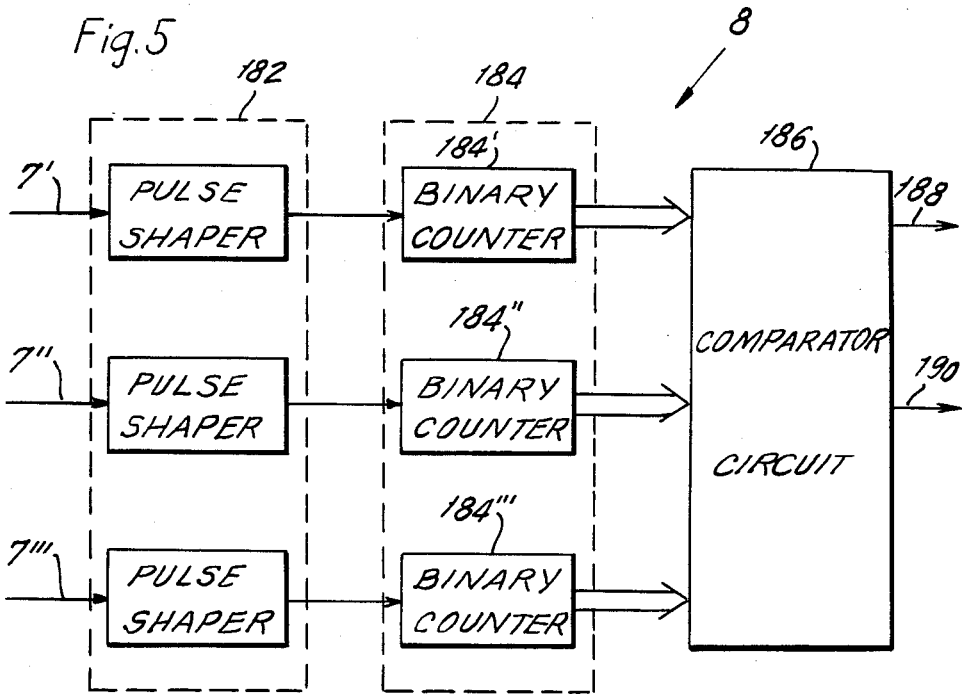
FIG. 5 is a schematic block diagram of a more complicated comparison circuit for use in the invention.

FIG. 5 shows a more complicated comparison circuit which may be used when it is not necessary to ensure that every rotation coincides, but only that the speeds of rotation are equal. In this embodiment, pulse shapers 182 ensure that the pulses on lines 7', 7'', 7''' are of the proper shape to drive binary counters 184. Binary counters 184 are, in turn, arranged to transmit their contents to comparator circuit 186 on the occurrence of timing signals not shown. A comparison could be made with a stored reference value, but in the preferred embodiment shown, the contents of counters 184', 184'' are each compared with the contents of counter 184'''. If the contents from either of counters 184', 184'' do not coincide with the contents from counter 184''', comparator circuit 186 emits a fault signal. Thus, line 188 will carry a fault signal if shaft 1'' is off-speed, while line 190 will carry a fault signal if shaft 1''' is off-speed.

In the embodiment of FIG. 5, it would be straightforward to compare only the most significant bits from counters 184, if it is not necessary to make a precise comparison. Also, binary counters 184, as shown, are cycling and do not require resetting, but resetting could be used to help time the comparison at comparator circuit 186, thus restarting operation will all counters at zero after each comparison.

The examples shown in FIGS. 4 and 5 do not exhaust the numerous possible embodiments of comparison circuit 8. It would be straightforward, for example, to use a microprocessor as the comparison circuit 8 in which case a comparison could also be made with a stored reference value. Also, an analog comparison could be made.

Figure 6:
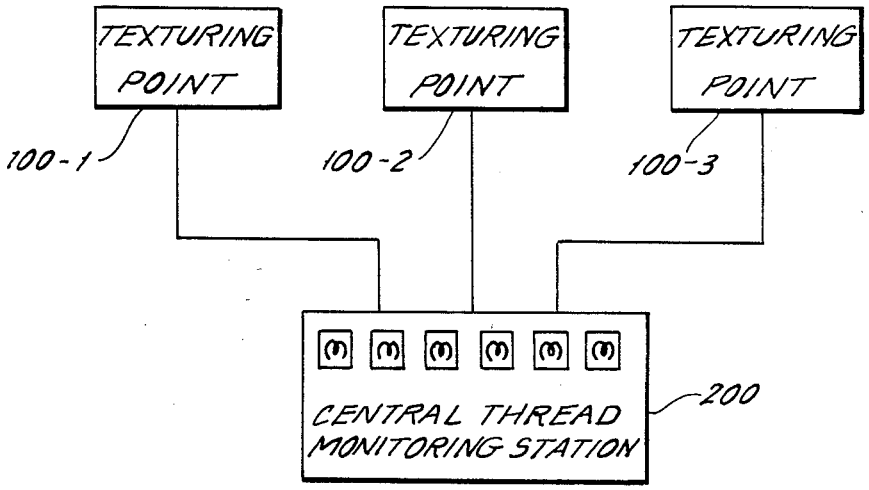
FIG. 6 is a schematic block diagram of a system incorporating the invention.

FIG. 6 shows a system incorporating the invention. A unit like that shown in FIG. 1, 2 or 3 is located at each texturing point 100-1, 100-2, 100-3. Signals from comparison circuits 8 are transmitted to a central thread monitoring station 200 where they activate a display or other indicating device. By viewing the display, an operator may observe which texturing point, if any, are not functioning properly.

The present invention may be embodied in other specific forms without departing from the spirit or essential attributes thereof and, accordingly, reference should be made to the appended claims, rather than to the foregoing specification, as indicating the scope of the invention.

What is claimed is:

1. A method for monitoring the texturing process in a friction false-twisting unit wherein the unit has three drive shafts, the axes of the drive shafts forming a triangle, each drive shaft bearing at least one friction disk and the disks on the shafts being interleaved, the method comprising:

rotating the shafts for rotating the disks; passing a thread through the interleaved friction disks in a zig-zag path;

sensing the respective speeds of rotation of at least two of the drive shafts and comparing each of the respective sensed speeds with a reference value; and producing a fault signal when one of the respective sensed speeds differs from the reference value.

2. A method for monitoring the texturing process in a friction false-twisting unit according to claim 1, wherein the rotating step comprises rotating one of the drive shafts, which is a main drive shaft, and the main drive shaft driving the other drive shafts, and the sensing step comprises sensing the respective speeds of rotation of all the drive shafts, the speed of rotation of the main drive shaft being the reference value, and the comparing step comprises comparing the reference value with the speed of rotation of each of the other drive shafts.

3. A method for monitoring the texturing process in a friction false-twisting unit according to claim 2, further comprising interrupting the passing of the thread in response to the fault signal.

4. A method for monitoring the texturing process in a friction false-twisting unit according to claim 3, wherein the interrupting comprises cutting the thread.

5. A method for monitoring the texturing process in a friction false-twisting unit according to claim 2, further comprising indicating at a central location where the fault signal originated.

6. A method for monitoring the texturing process in a friction false-twisting unit according to claim 1, further comprising generating a speed of rotation signal for the sensed speed of each shaft; and the comparing step comprises comparing the speed of rotation signals for producing the fault signal when one of said signals differs from the reference value.

7. A method for monitoring the operation of a friction false-twisting unit of the type having a plurality of shafts each carrying a respective friction disk for rotating with the shaft for texturing a thread, the method comprising:

rotating the shafts for rotating the disks; passing a thread past the disks;

comparing the respective speeds of rotation of at least two of the shafts with a reference value to determine whether one of the respective speeds differs from the reference value; and producing a fault signal when the comparing step determines that one of the respective speeds differs from the reference vlaue.

8. The method of claim 7, further comprising generating a signal corresponding to each respective speed of rotation; generating a reference signal corresponding to the reference value; the comparing step comprises determining whether the signal corresponding to each respective speed of rotation differs from the reference signal.

9. The method of claim 7, wherein the rotating step comprises rotating one of the shafts which serves as a drive shaft and the drive shaft driving the other shafts to rotate; the speed of rotation of the drive shaft being the reference value and the comparing step comprises comparing the speed of rotation of each of the other shafts with the speed of rotation of the drive shaft.

10. The method of claim 7, further comprising the step of cutting the thread for interrupting further movement of the thread from the unit when the fault signal is produced.

11. The method of claim 7, further comprising the step of providing an indication that the fault signal is being produced.

12. An apparatus for monitoring the operation of a friction false-twisting unit, wherein the unit includes a plurality of shafts and each shaft carries at least one disk for texturing a thread drawn past the disks, the monitoring apparatus comprising:

a sensor circuit for providing respective speed signals corresponding to the respective speeds of rotation of at least two of the shafts;

means for generating a reference signal corresponding to a desired speed of rotation; and a comparison circuit for comparing the respective speed signals to the reference signal and for producing a fault signal if one of the respective speed signals differs from the reference signal.

13. The apparatus of claim 12 wherein one of the shafts is a drive shaft connected to the other shafts for driving the other shafts to rotate; the sensor circuit being disposed for providing a respective speed signal indicating the speed of rotation of each shaft; the means for generating a reference signal generating a speed signal corresponding to the speed signal produced by the sensor circuit for the drive shaft; the comparison circuit comparing each of the respective speed signals which indicate the speeds of the respective other shafts with the reference signal which indicates the speed of the drive shaft.

14. The apparatus of claim 13, wherein the drive shaft is connected to the other shafts by respective drive belts, the sensor circuit comprising a respective pulse transmitter mounted on each drive belt for providing a pulse signal corresponding to the speed of that belt; the sensor circuit further comprising a respective pulse receiver fixed in position on the unit for receiving the respective pulse signal of each pulse transmitter.

15. The apparatus of claim 12, further comprising an interrupting device responsive to the fault signal for interrupting further movement of thread from the unit.

16. The apparatus of claim 15, wherein the interrupting device comprises a thread cutting device for cutting the thread.

17. The apparatus of claim 12, further comprising a central thread monitoring station responsive to the fault signal for indicating that a fault signal was produced.

18. The apparatus of claim 17, wherein there are a plurality of the friction false-twisting units, each with a respective comparison circuit; the central thread monitoring station being connected for receiving fault signals from a plurality of the comparison circuits, the monitoring station comprising indicating means for indicating which comparison circuit produced each fault signal.

19. The apparatus of claim 12, wherein the sensor circuit comprises a respective pulse transmitter mounted on the unit for producing a pulse signal corresponding to the speed of rotation of each of at least two of the shafts, the sensor circuit further comprising a respective pulse receiver for receiving the pulse signal.

20. The apparatus of claim 19, wherein each pulse transmitter is a magnet turning with the respective shaft.

21. The apparatus of claim 20 in which the magnet is mounted in the respective shaft.

22. The apparatus of claim 20 in which a drive wheel is fastened on the respective shaft for driving the respective shaft, the magnet being mounted in the drive wheel.

23. The apparatus of claim 20 in which the pulse receiver comprises a Hall effect sensor mounted in a fixed position on the unit.

* * * * *